US006371873B1

(12) United States Patent
Wang

(10) Patent No.: US 6,371,873 B1
(45) Date of Patent: Apr. 16, 2002

(54) GOAL ASSEMBLY

(76) Inventor: Cheng-Liang Wang, No. 57, Chung Ho St. Tainan City, Tainan (TW)

( * ) Notice: Subject to any disclaimer, the term of this patent is extended or adjusted under 35 U.S.C. 154(b) by 0 days.

(21) Appl. No.: 09/562,631

(22) Filed: May 2, 2000

(51) Int. Cl.[7] ..... A63B 63/00

(52) U.S. Cl. ..... 473/478; 473/415; 473/476; 273/407; 403/102

(58) Field of Search ..... 273/348, 354, 273/390–393, 400–404, 108.1, 407, 127 D, 127 R; 473/421, 422, 446, 490–495, 476–479, 232; 403/57, 61, 119, 150, 157, 102; 135/139, 143, 152; 16/254, 331; 248/127, 136, 158, 165, 183.1; 43/12; 160/135, 139; 5/99.1

(56) References Cited

U.S. PATENT DOCUMENTS 1,039,986 A * 10/1912 Merritt ..... 403/102
4,131,378 A * 12/1978 Daws ..... 403/102
4,611,945 A * 9/1986 Diego ..... 403/102
5,178,583 A * 1/1993 Rankin ..... 403/102
5,217,315 A * 6/1993 Rosane ..... 403/102
5,539,957 A * 7/1996 Schmidt ..... 473/478
5,544,864 A * 8/1996 Gabriel-Lacki et al. ..... 403/102
5,681,045 A * 10/1997 Liao ..... 273/400
5,746,533 A * 5/1998 Schmidt ..... 403/102
5,954,600 A * 9/1999 Gill ..... 473/478

* cited by examiner

*Primary Examiner*—Paul T. Sewell
*Assistant Examiner*—Mitra Aryanpour
(74) *Attorney, Agent, or Firm*—Rosenberg, Klein & Lee

(57) ABSTRACT

A goal assembly includes two lengthwise assemblies and two L-shaped assemblies which are pivotally connected between the two lengthwise assemblies which are parallel with each other on different horizontal planes. Each lengthwise assembly has two sections pivotally connected by a connection member. Each L-shaped assembly includes a post and a widthwise bar pivotally connected with each other. A net is connected to the two lengthwise assemblies and the two L-shaped assemblies.

1 Claim, 9 Drawing Sheets

GOAL ASSEMBLY

FIELD OF THE INVENTION

The present invention relates to a goal assembly, and more particularly, to a goal assembly wherein the crossbar is composed of two sections and the two goal posts each can be pivoted relative to the crossbar so as to have a compact size for convenience of storage.

BACKGROUND OF THE INVENTION

A conventional generally goal assembly for kids is shown in FIG. 10, includes a crossbar 50 two posts 60 which are connected to two ends of the crossbar 50 by two elbow members 80. Two base tubes 70 respectively connected to the two posts by two elbow members. A rear bar 51 is connected between the two base tubes 70 by two elbow members. The base tubes 70 and the rear bar 51 provide support for the combination of the crossbar 50 and the two posts 60. A net 90 is connected to the crossbar 50, the two posts 60 and the rear bar 51. The conventional goal is advantageously disengaged into many tubes so that they occupy a small space. However, to assemble the goal takes a lot of time and requires certain skill. The assembling process is difficult for kids to finish by themselves. The base tubes 70 and the two posts 60 are easily separated from each other when a ball hits the net 90 with a large force because the base tubes 70 and the two post 60 are simply connected by elbow members. Similarly, the connection between the crossbar 50 and the two posts 60 has the same problem.

The present invention intends to provide a goal assembly wherein the tubes are pivotally connected with each other so that they are not supposed to be separated by the ball hitting the net.

SUMMARY OF THE INVENTION

In accordance with one aspect of the present invention, there is provided a goal assembly comprising two lengthwise assemblies located in parallel with each other on different horizontal planes, two L-shaped assemblies connected between the two lengthwise assemblies, and a net connected to the two lengthwise assemblies and the two L-shaped assemblies.

Each lengthwise assembly composed of two first sections pivotally connected by a connection member. Each first section has a first end connected to a first end of a first elbow member and a second end of each first section has a first slit defined therein. Two first lugs or segments were separated by the first slit in the second end of each first section and each first lug has a first protrusion extending toward the first slit. The connection member had two first tongues and each first tongue has a first hole defined therein. The connection member is connected between the two first sections and the two first tongues are respectively engaged with the two first slits of the two first sections. Each first hole receives the two protrusions in the two first sections. A first sleeve is movably mounted to the connection member.

Each L-shaped assembly comprises a post and a widthwise bar which is pivotally connected to the post by a second elbow member. The second elbow member is the same as the first elbow member. The post and the widthwise bar are respectively and pivotally connected to the second ends of the two first elbow members of the two lengthwise assemblies. Each widthwise bar is pivotally connected between the second end of the first elbow member and a second end of the second elbow member.

The object of the present invention is to provide a goal assembly that provides a good connection between parts thereof and the parts composing the goal assembly can be pivoted to make the goal assembly have a compact size.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
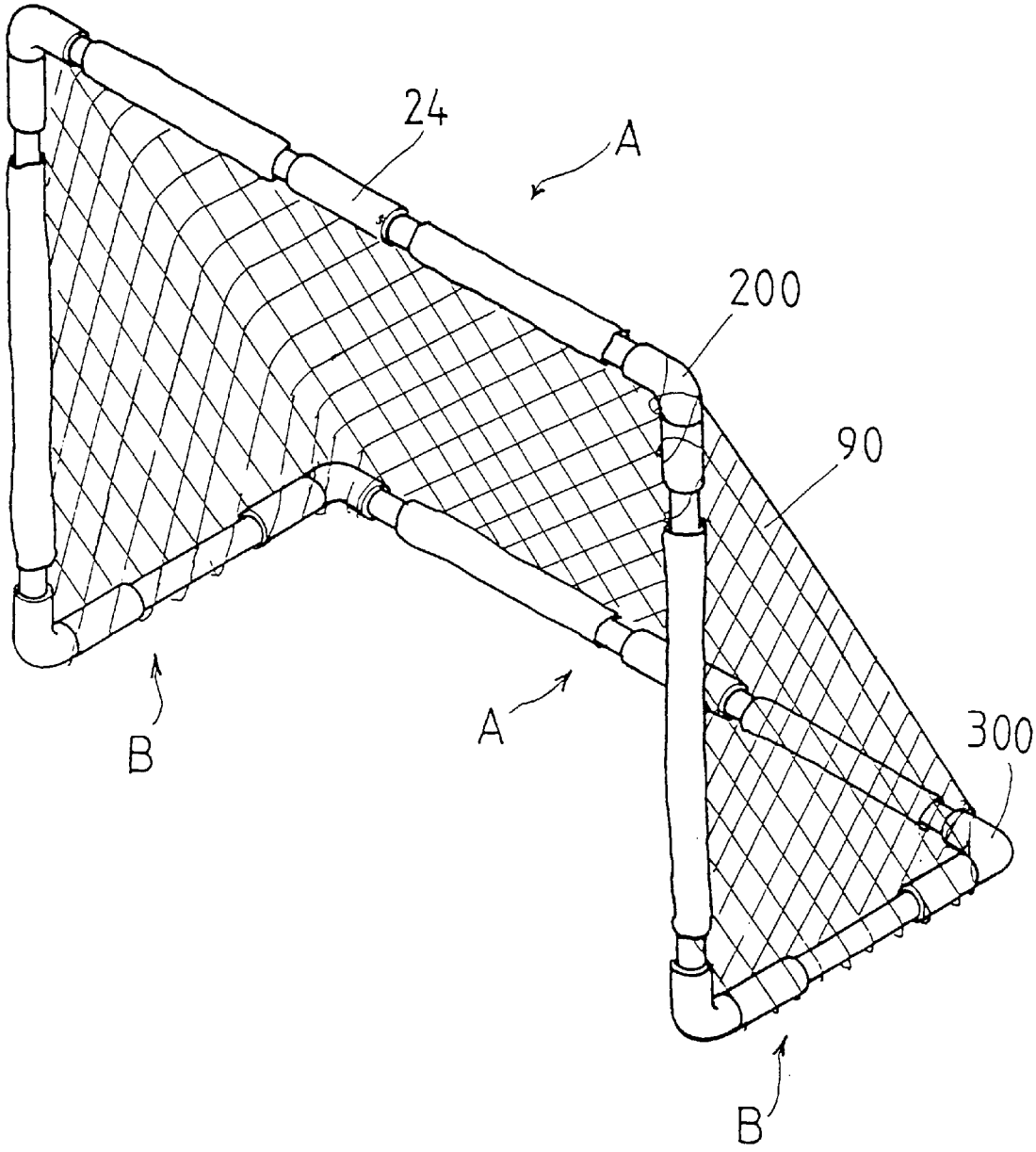
FIG. 1 is a perspective view to show a goal assembly of the present invention.
Figure 2:
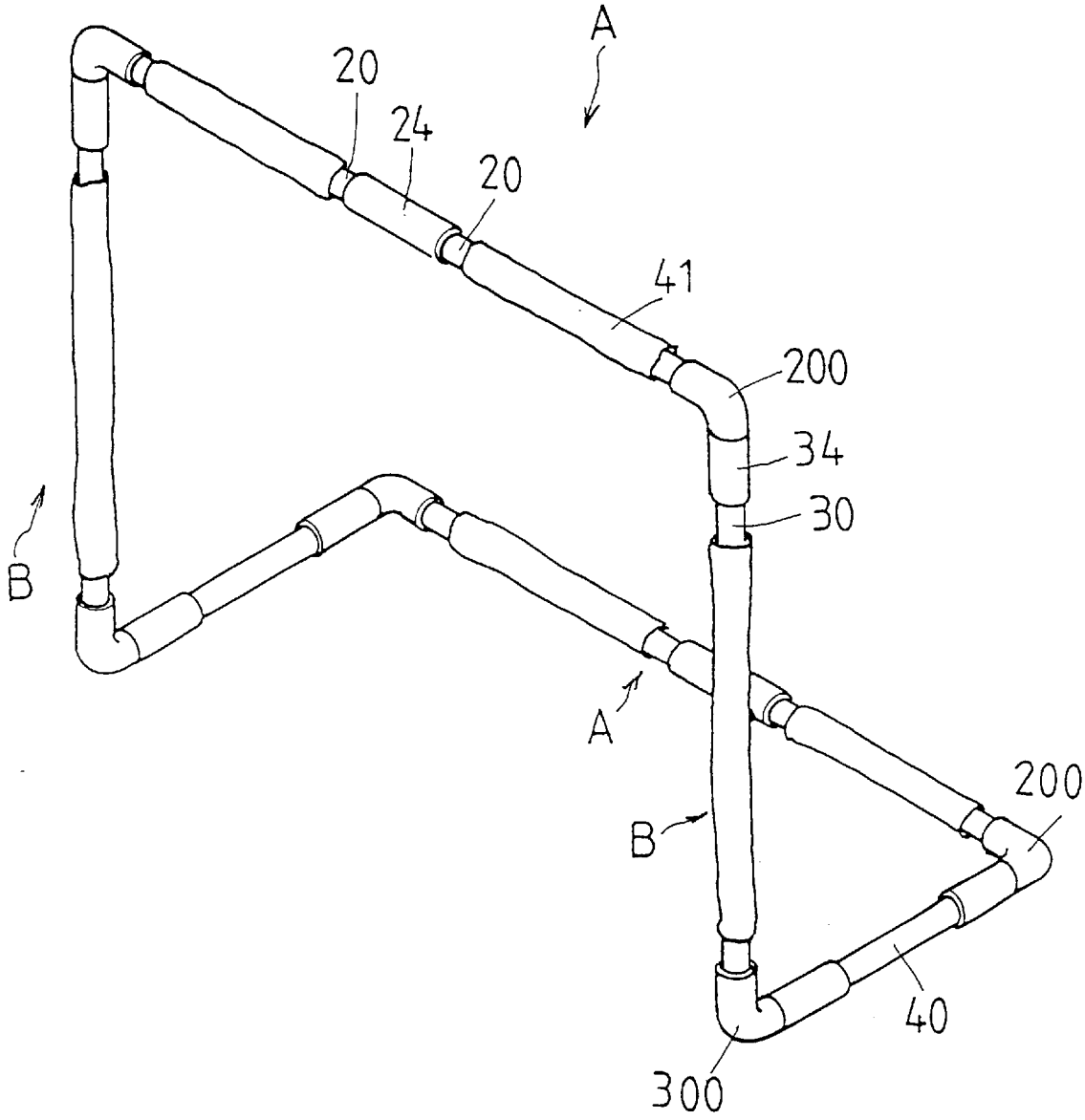
FIG. 2 is a perspective view to show the goal assembly of the present invention wherein a net of the goal assembly is removed.

Referring to FIGS. 1 and 2, the goal assembly in accordance with the present invention comprises two lengthwise assemblies "A" and two L-shaped assemblies "B" which are pivotally connected between the two lengthwise assemblies "A" which are located in parallel with each other on different horizontal planes. A net 90 is connected to the two lengthwise assemblies "A" and the two L-shaped assemblies "B".

Figures 3, 3A:
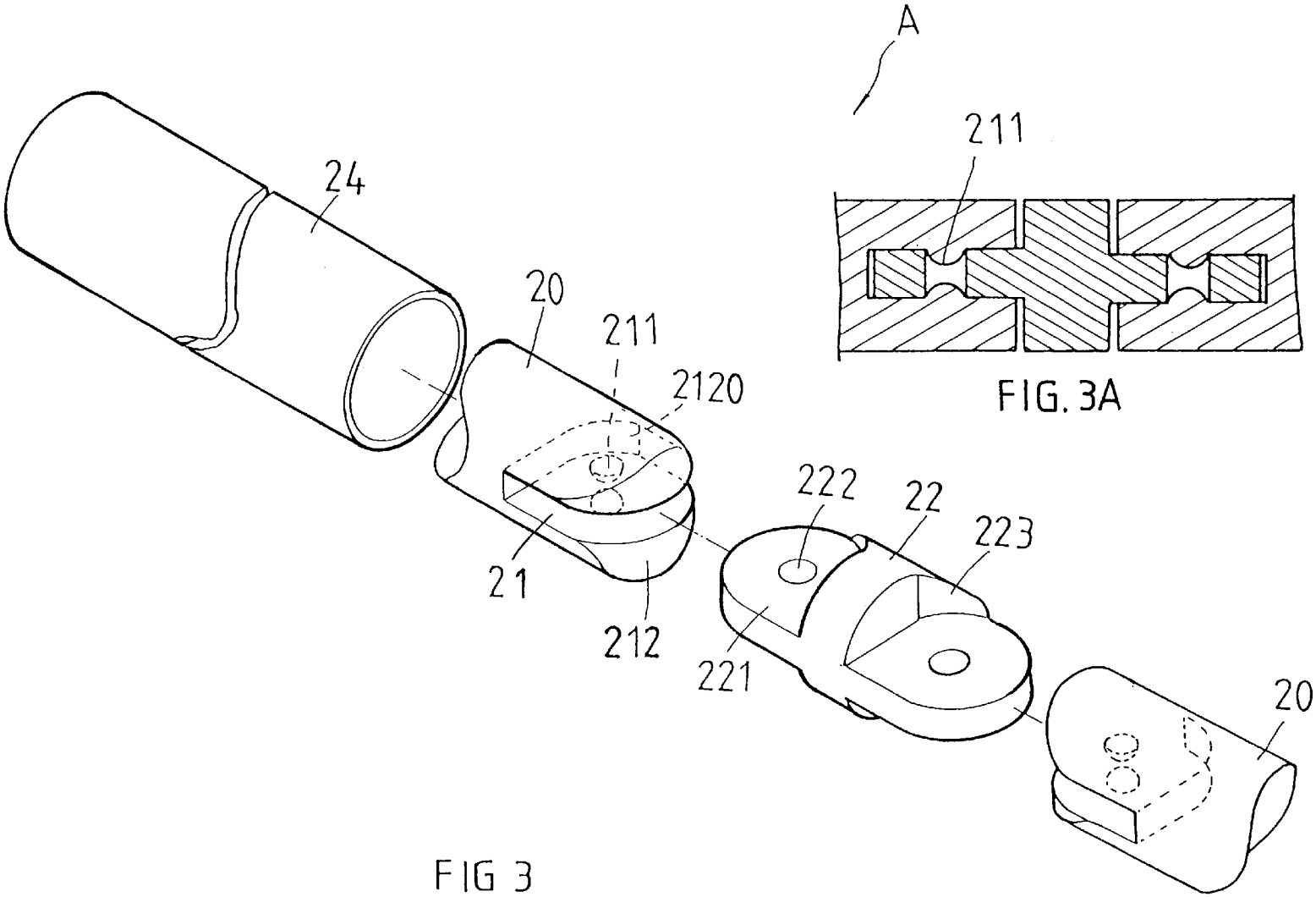
FIG. 3 shows a perspective of a connection member and two first sections of a lengthwise assembly.
FIG. 3A shows cross section of a connection member and two first sections of a lengthwise assembly of FIG. 3.
Figure 4:
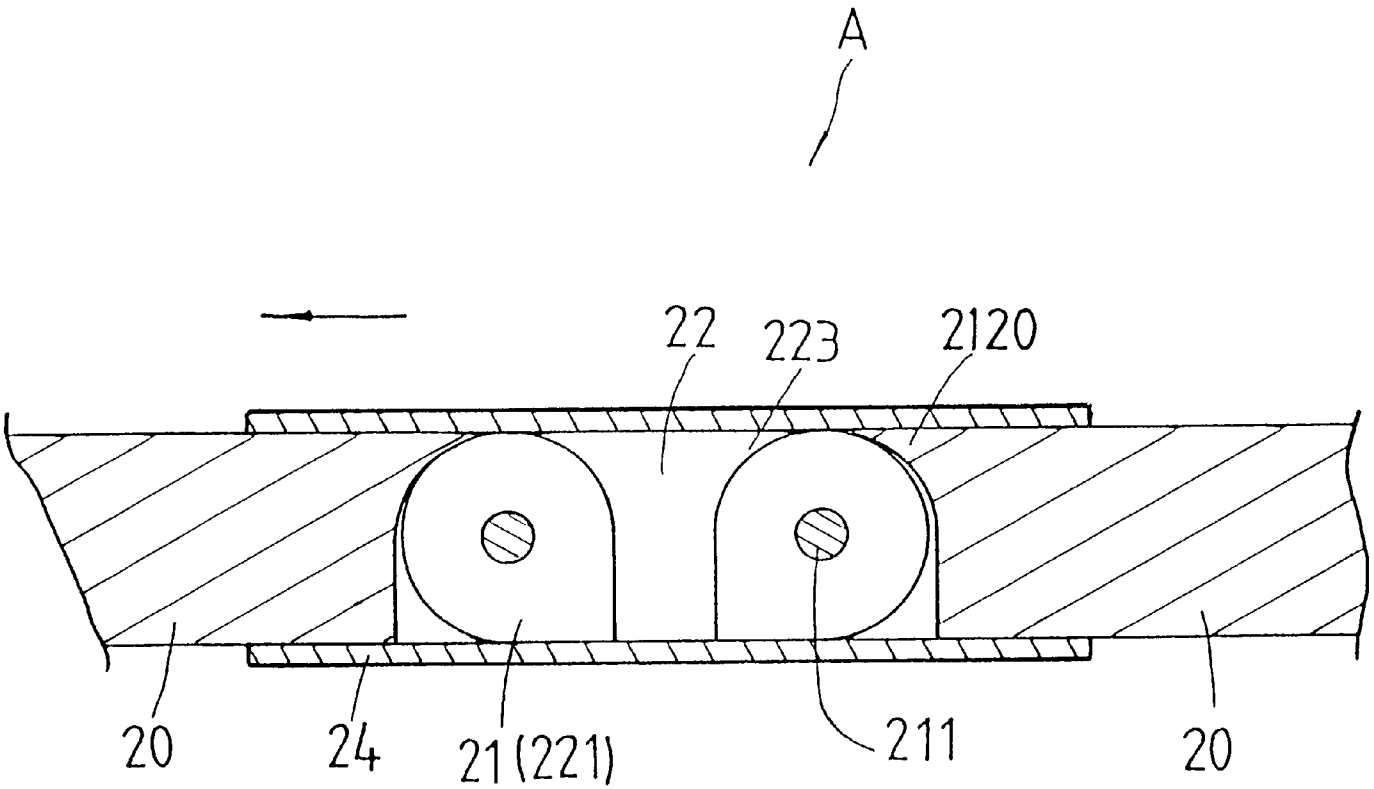
FIG. 4 is a side elevational view, partly in section, of the combination of the connection member and the two first sections.
Figure 5:
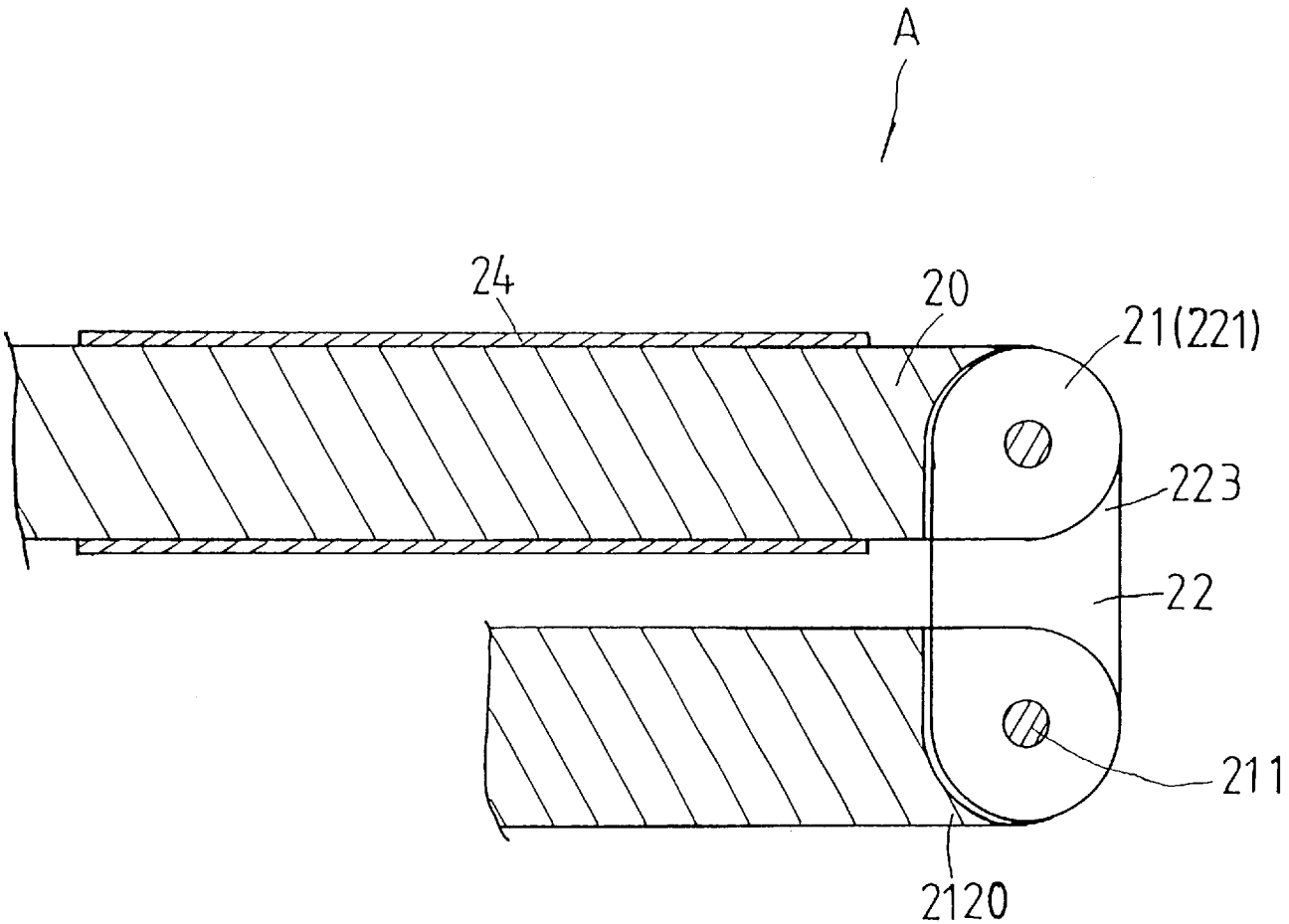
FIG. 5 is a side elevational view, partly in section, of the combination of the connection member and the two first sections, wherein the two first sections are pivoted with each other.

Referring to FIGS. 3 and 4, each lengthwise assembly "A" is composed of two first sections 20 pivotally connected by a connection member 22. Each first section 20 has a first end connected to a first end of a first elbow member 200 and a second end of each first section 20 has a first slit 21 defined therein so as to define two first segments 212 separated by the first slit 21 in the second end of each first section 20 and each first segments 212 has a first circular protrusion 211 extending toward the first slit 21. A curve surface 2120 is connected between the two first segments 212. The connection member 22 has two first tongues 221 and each first tongue 221 has a first circular hole 222 defined therein. The connection member 22 is connected between the two first sections 20, the two first tongues 221 respectively engaged with the two first slits 21 of the two first sections 20. Each first circular hole 222 receives the two circular protrusions 211 in the two first sections 20. A surface 223 is connected between each first tongue 221 and the body of the connection member 22. Therefore, the rounded end of each first segment 212 is smoothly and pivotably engaged with the first slits 21. As shown in FIG. 4, a sleeve 24 is movably mounted to the connection member 22 to prevent the two first sections 20 from being pivoted when the goal assembly is in used. As shown in FIG. 5, when the sleeve 24 is shifted away from the connection member 22, the two first sections 20 can be respectively pivoted relative to the connection member 22.

Each L-shaped assembly "B" comprises a post 30 and a widthwise bar 40 which is pivotally connected to the post 30 by a second elbow member 300. The second elbow member 300 has an identical structure as the first elbow member 200. The post 30 and the widthwise bar 40 are respectively and pivotally connected to the second ends of the two first elbow members 200 of the two lengthwise assemblies. Each widthwise bar 40 is pivotally connected between the second end of the first elbow member 200 and a second end of the second elbow member 300. It is to be noted that the second end of each of the first elbow member 200 and the second elbow member 300 is a pivotal end so that the widthwise bar 40 can be pivoted relative to the first elbow member 200 and the second elbow member 300.

Figure 6A:
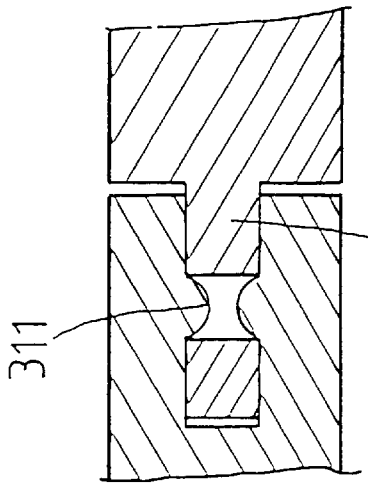
FIG. 6A shows a cross section of an elbow member and two posts of the L-shaped assembly of the goal assembly of FIG. 3.
Figure 6:
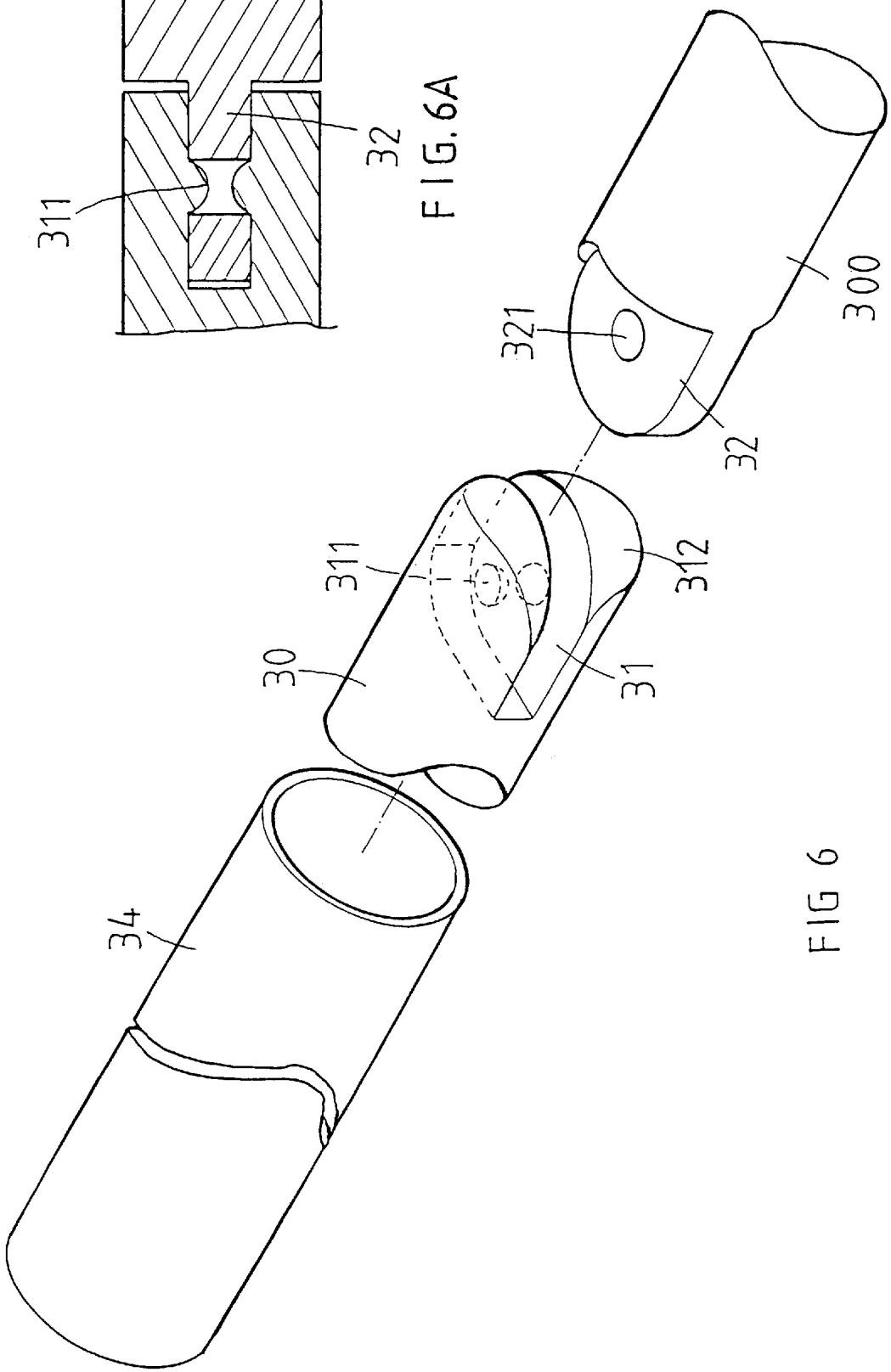
FIG. 6 shows a perspective of an elbow member and two posts of the L-shaped assembly of the goal assembly.
Figure 8:
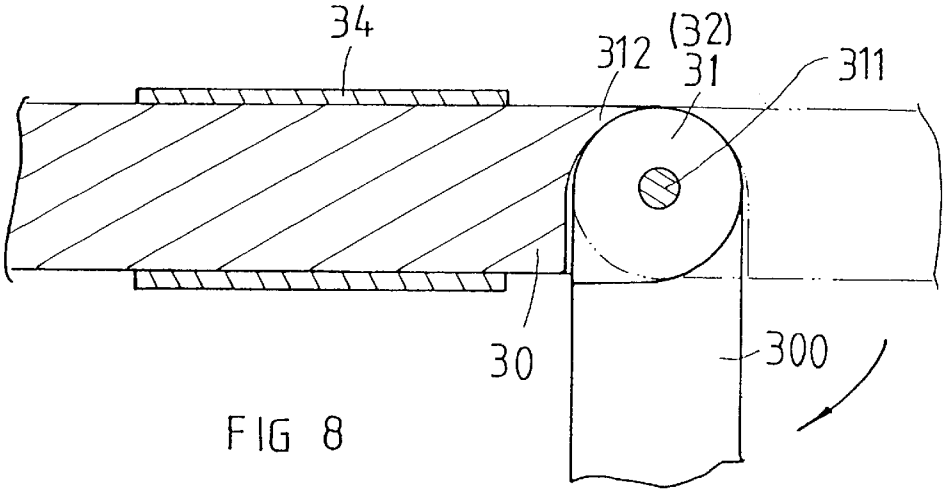
FIG. 8 is a side elevational view, partly in section, of the combination of the post and the elbow member, wherein the elbow member is pivoted relative to the post.
Figure 7:
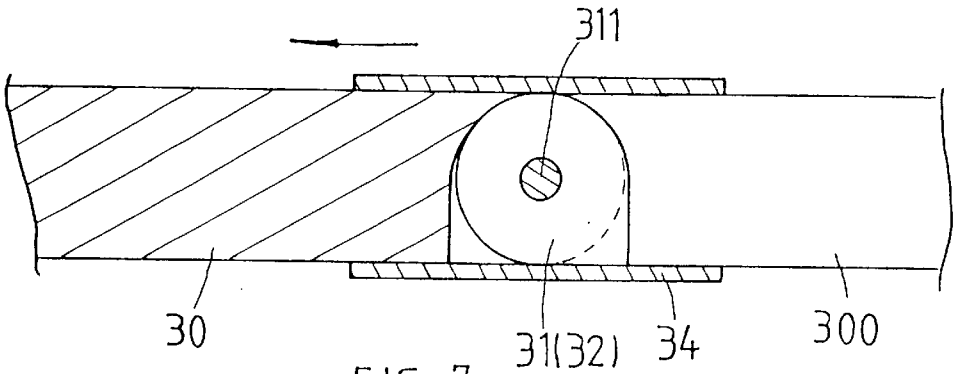
FIG. 7 is a side elevational view, partly in section, of the combination of the post and the elbow member.

Referring to FIGS. 6 and 7, a second tongue 32 extends from a second end of each first elbow member 200 and each second elbow member 300. A circular aperture 321 is defined in each second tongue 32. A first end of each post 30 has a second slit 31 defined therein so as to define two second segments 312 separated by the second slit 31 in the first end of each post 30. Each second segment 312 has a second circular protrusion 311 extending toward the second slit 31. Each circular aperture 321 receives the two second circular protrusions 311 in the two posts 30. A second sleeve 34 is movably mounted to the second end of each first elbow member 200 so as to prevent the post 30 or the widthwise bar 40 from being pivoted when in use. As shown in FIG. 8, when the second sleeve 34 is shifted away from the first elbow member 200 or the second elbow member 300, the post 30 or the widthwise bar 40 can be pivoted.

Figure 9:
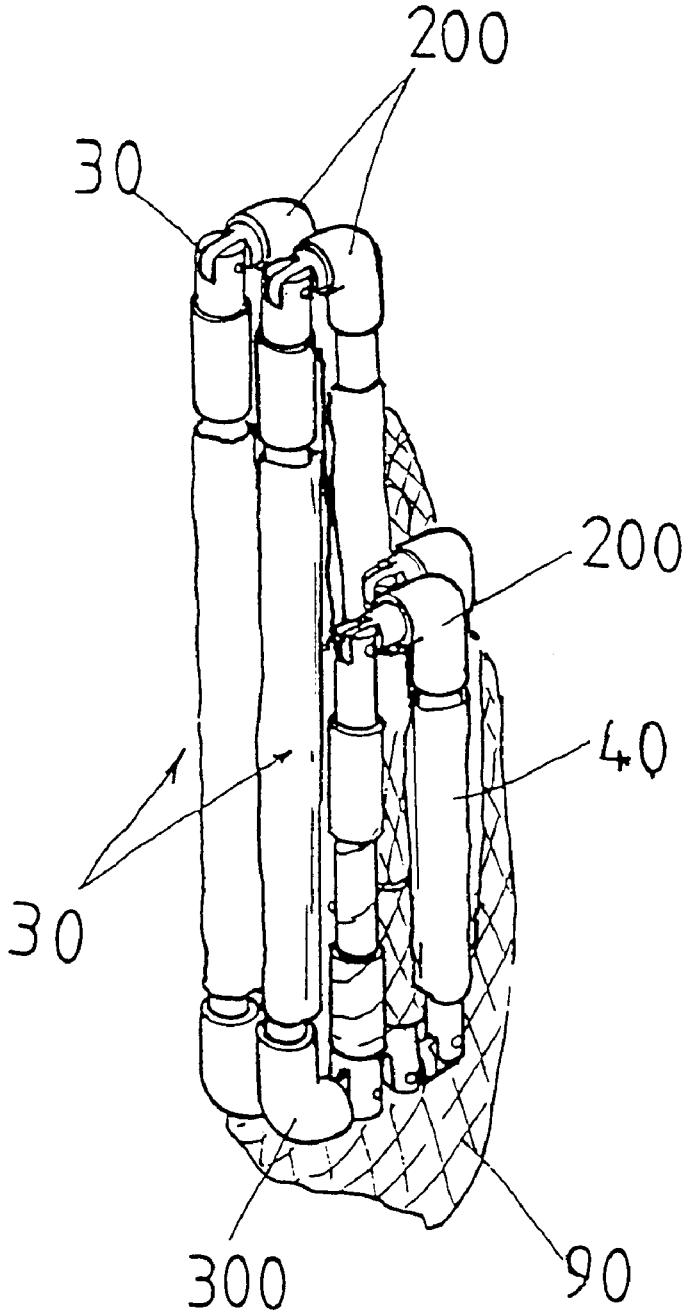
FIG. 9 is a perspective view to show the folded goal assembly.
Figure 10:
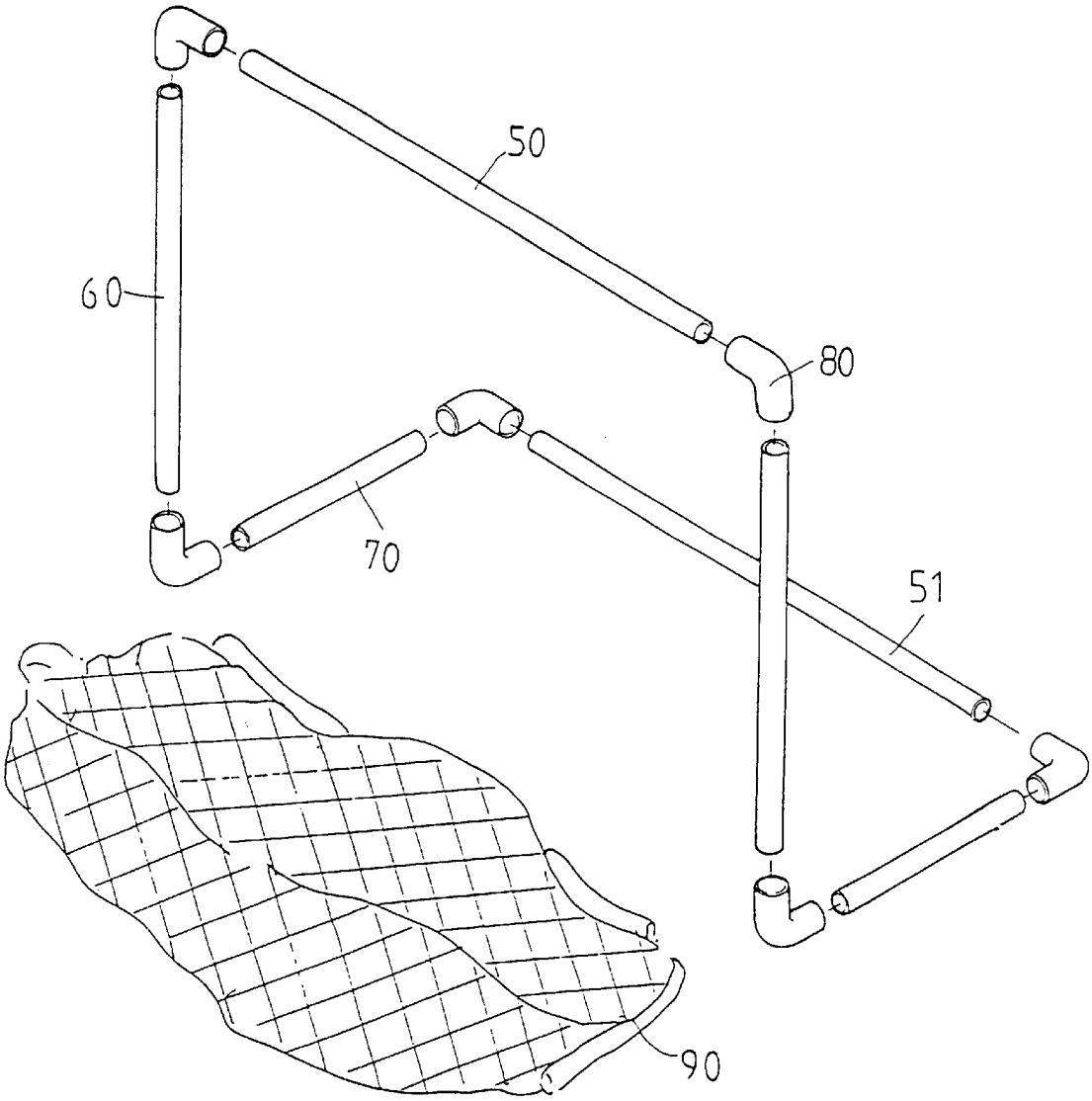
FIG 10 PRIOR ART
FIG. 10 is an exploded view to show a conventional goal assembly.

FIG. 9 shows the folded status of the goal assembly that becomes a compact size and is convenient for storage. The parts composing the goal assembly of the present invention are securely connected with each other so that they will not be lost.

While we have shown and described various embodiments in accordance with the present invention, it should be clear to those skilled in the art that further embodiments may be made without departing from the scope and spirit of the present invention.

What is claimed is:

1. A goal assembly comprising:

two lengthwise assemblies located in parallel with each other on different horizontal planes;

each lengthwise assembly composed of two first sections pivotally connected by a connection member, each first section having a first end connected to a first end of a first elbow member and a second end of each first section having a first slit defined therein so as to define two first segments separated by said first slit in said second end of each first section, each first segment having a first circular protrusion extending toward said first slit;

said connection member having two first tongues and each first tongue having a first circular hole defined therein, said connection member connected between said two first sections, said two first tongues respectively engaged with said two first slits of said two first sections, each first circular hole receiving said two circular protrusions in said two first sections, a first sleeve movably mounted to said connection member;

two L-shaped assemblies respectively and pivotally connected between said two lengthwise assemblies, each L-shaped assembly comprising a post and a widthwise bar which is pivotally connected to said post by a second elbow member, said second elbow member being the same as said first elbow member, said post and said widthwise bar respectively and pivotally connected to said second ends of said two first elbow members of said two lengthwise assemblies, each widthwise bar pivotally connected between said second end of said first elbow member and a second end of said second elbow member, a second tongue extending from a second end of each first elbow member and each second elbow member, a circular aperture defined in each second tongue, a first end of each post having a second slit defined therein so as to define two second segments separated by said second slit in said first end of each post, each second segment having a second circular protrusion extending toward said second slit, each circular aperture receiving said two second circular protrusions in said two posts, a second sleeve movably mounted to said second end of each first elbow member, and a net connected to said two lengthwise assemblies and said two L-shaped assemblies.

* * * * *